United States Patent [19]

Johnson

[11] 4,106,290

[45] Aug. 15, 1978

[54] PROTECTIVE CAP ASSEMBLY FOR AN EXHAUST PIPE

[76] Inventor: Donald E. Johnson, 2208 Highway 51, Stoughton, Wis. 53589

[21] Appl. No.: 798,250

[22] Filed: May 18, 1977

[51] Int. Cl.[2] ..... F01N 7/00; F23L 17/02

[52] U.S. Cl. ..... 60/324; 98/59

[58] Field of Search ..... 60/324; 98/59, 85

[56] References Cited

U.S. PATENT DOCUMENTS

| | | | |
|---|---|---|---|
| 2,420,700 | 5/1947 | Curphy | 60/324 |
| 3,012,495 | 12/1961 | Miller | 98/85 |
| 3,022,717 | 2/1962 | Webster | 98/59 |
| 3,110,239 | 11/1963 | Dashwood | 98/59 |
| 3,446,010 | 5/1969 | Hopkins | 60/324 |

*Primary Examiner*—Douglas Hart

*Attorney, Agent, or Firm*—Andrus, Sceales, Starke & Sawall

[57] ABSTRACT

A protective cap assembly for an exhaust pipe. The cap assembly includes an inverted generally conical cap which is adapted to engage the upper end of the exhaust pipe to close off the pipe during periods when exhaust gas is not being discharged from the exhaust pipe. A series of supports are connected to the periphery of the cap and extend downwardly along the inner surface of an outer housing and are connected to a ring which is mounted for sliding movement with respect to the housing. During periods when the exhaust gas is being discharged from the exhaust pipe, the pressure of the exhaust gas will raise the cap from the exhaust pipe and upward movement of the cap is limited by engagement of the ring with a stop formed on the inner surface of the housing. The lower end of the housing is provided with a smaller diameter and is clamped to the outer surface of the exhaust pipe, and a series of drain holes are formed in the housing adjacent the smaller diameter lower end to permit draining of any water which may accumulate in the space between the housing and the exhaust pipe. The conical configuration of the cap serves to deflect the exhaust gas upwardly and outwardly as well as centering the cap with respect to the pipe.

10 Claims, 3 Drawing Figures

Fig. 1
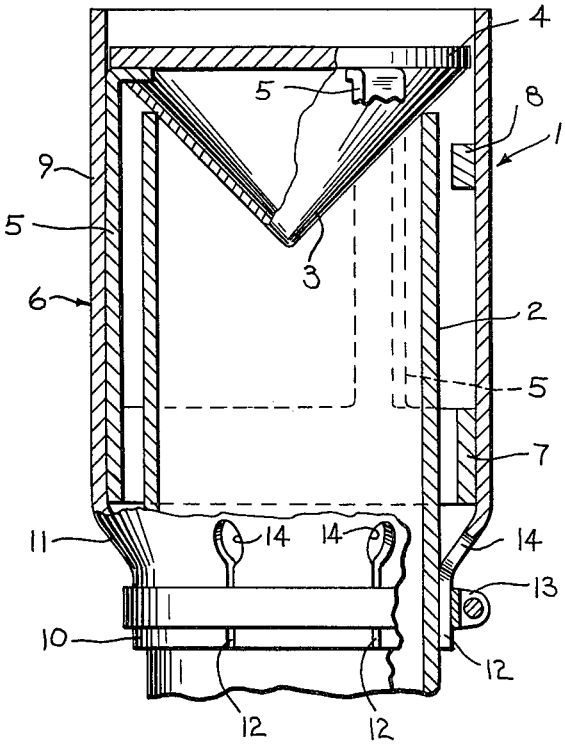
Fig. 3
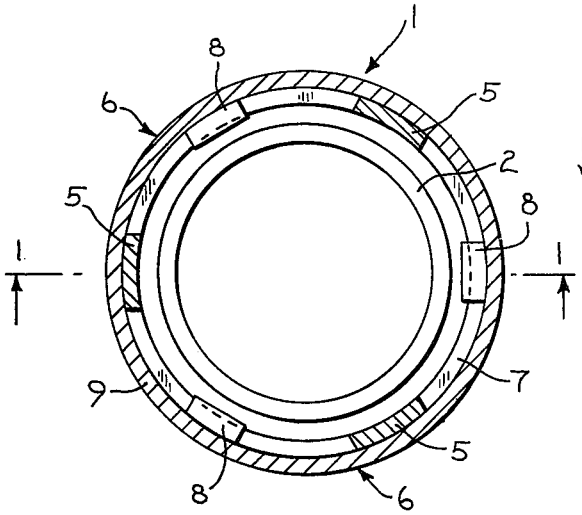
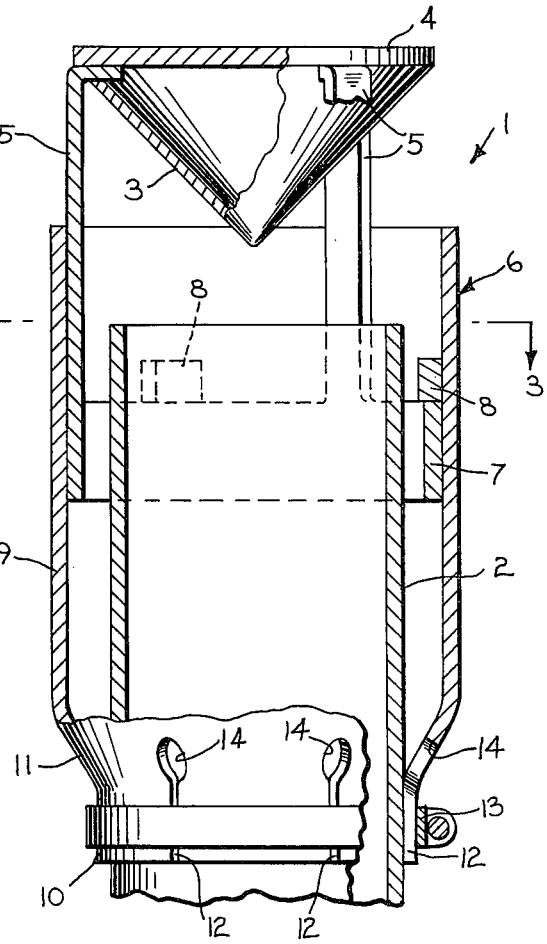
Fig. 2

PROTECTIVE CAP ASSEMBLY FOR AN EXHAUST PIPE

BACKGROUND OF THE INVENTION

Many types of internal combustion engines, such as those used with tractors, heavy construction equipment, trucks, and the like, have vertically extending exhaust pipes, and protective caps are frequently associated with the vertical exhaust pipe to prevent rain and snow from entering the exhaust pipe, as well as to prevent foreign objects from entering the pipe during periods of non-use of the engine.

One type of protective cap that has been used in the past is a flap which is pivoted to the upper end of the exhaust pipe and is movable under the pressure of the exhaust gas from a closed horizontal position to a pivoted open position.

A second form of protective cap that has been employed in the past includes a flat plate that engages the upper end of the exhaust pipe and moves vertically relative to the pipe under the pressure of the exhaust gas.

Protective caps as used in the past have had certain disadvantages. In some cases the protective cap can only be used on original equipment and cannot be mounted on existing exhaust pipes, while in other cases, substantial modification of the exhaust pipe is required in order to install the protective cap.

A further disadvantage of the protective cap as used in the past has been the tendency of the cap to rattle or vibrate when the cap is in the raised position during the operation of the engine, and in some cases strong winds have opened the cap during periods of non-operation of the engine, permitting rain and snow to enter the exhaust pipe.

SUMMARY OF THE INVENTION

The invention is directed to an improved protective cap assembly to be associated with an exhaust pipe of an internal combustion engine. The cap assembly of the invention includes an inverted, generally conical cap which is adapted to engage the upper end of the exhaust pipe during periods of non-operation of the engine to close off the pipe. A series of supports are connected to the peripheral edge of the cap and extend downwardly along the inner surface of a housing, which is spaced outwardly of the exhaust pipe, and the supports are connected to a ring which is adapted to slide relative to the housing.

During operation of the engine, the exhaust gases raise the cap from the end of the exhaust pipe and upward movement of the cap is limited by engagement of the ring with stops or abutments formed on the inner surface of the housing.

The lower end of the housing is provided with a reduced diameter and is clamped to the exhaust pipe and is connected to the main portion of the housing by a tapered shoulder. A plurality of drain holes are formed in the shoulder and enable water to drain from the space between the housing and the pipe.

During periods of non-operation of the invention, the conical cap firmly engages the upper end of the exhaust pipe to prevent rain, snow and other objects from entering the exhaust pipe. As the cap is located beneath the level of the upper end of the housing, the cap cannot be opened by strong winds and the unit is tamper resistant in that it is very difficult to pry the cap upwardly from the exhaust pipe even through use of a tool.

During operation of the engine, the pressure of the exhaust gas will lift the cap upwardly and the concical configuration serves to deflect the gases outwardly and upwardly. This is a substantial improvement over the use of a flat plate which tends to deflect the gases radially. In case of a tractor or heavy construction equipment, the radial deflection of the gas can be a hazard to the operator of the equipment.

The cap of the invention seals the exhaust pipe against the entry of rain or foreign material while the engine is not operating in all weather conditions, and yet permits, during periods of engine operation, the exhaust gas to escape in a generally upward direction in sufficient volume so that back pressure will not be increased and the noise level is minimized. The conical configuration also provides a self-centering feature for the cap both in the closed and open positions. During operation, the gases will be deflected by the apex of the cone, causing the cone to center itself with respect to the pipe and thus minimize rattling of the unit during operation. Similarly, when the engine operation ceases and the cone falls by gravity to the closed position, it will center itself within the exhaust pipe.

The cap assembly can be associated with any existing square-ended exhaust pipe by merely clamping the lower end of the housing to the pipe. It is not necessary to alter or modify the pipe in any manner in order to install the cap assembly.

DESCRIPTION OF THE DRAWINGS

The drawings illustrate the best mode presently contemplated of carrying out the invention.

In the drawings:

FIG. 1 is a vertical section of the protective cap assembly of the invention as associated with an exhaust pipe and showing the cap in the closed position;

FIG. 2 is a view similar to FIG. 1 showing the cap in the raised or open position; and FIG. 3 is a section taken along line 3-3 of FIG. 1.

DESCRIPTION OF THE PREFERRED EMBODIMENT

The drawings illustrate a protective cap assembly 1 to be associated with a vertical exhaust pipe 2 of an internal combustion engine. The protective cap assembly 1 includes an inverted conical cap 3, which is adapted to engage the upper end of the exhaust pipe 2 to close off the pipe during periods of nonoperation of the engine.

The upper end of the conical cap 3 is attached to a plate 4 and a series of supports 5 are connected to the peripheral edge of plate 4 and extend downwardly along the inner surface of an outer housing 6 which is spaced outwardly of the exhaust pipe 2. The lower ends of the supports 5 are connected to a ring 7 which is mounted for sliding movement with respect to the housing. When the engine is operated, the pressure of the exhaust gas will displace the conical cap 3 from the upper end of the exhaust pipe, and upward movement of the cap is limited by the engagement of the ring 7 which a series of annular stops or abutments 8 formed on the inner surface of the housing 6.

As best illustrated in FIG. 1, the housing 6 includes a generally cylindrical upper portion 9, a lower portion 10 of reduced diameter and a tapered shoulder 11 which connects the upper and lower portions. To attach the housing to the exhaust pipe, the lower portion 10 is provided with a plurality of axial slits 12 and a standard clamping ring 13 clamps the lower portion 11 to the pipe 2. The upper ends of the slits 12 are enlarged to form drain holes 14 through which water can drain from the space between housing 6 and pipe 2.

When the engine is not operating and the conical cap 3 is seated on the end of the exhaust pipe 2, the plate 4 is located beneath the upper extremity of the housing 6 and this results in the unit being tamper resistant. Due to the minimum clearance between the peripheral edge of the plate 4 and the housing 6, it is very difficult to pry the cap upwardly even with the use of a tool.

FIG. 1 illustrates the position of the cap when the engine is not operating and in this position the cap 3 seals off the end of the exhaust pipe 2. Because of the conical configuration, the cap is self-centering within the pipe.

When the engine is operated, the pressure of the exhaust gas will raise the cap to the position shown in FIG. 2, and upward movement of the cap is limited by engagement of the ring 7 with the stops 8. In this position the exhaust gases will be deflected upwardly, and the conical configuration of the cap will tend to center the cap relative to the axis to the exhaust pipe and thereby prevent rattling of the cap assembly during operation of the engine.

As the gases are deflected upwardly and outwardly, the deflected gases will not be a hazard to the operator of a tractor or heavy construction equipment, as may be the case of the gases were deflected merely in a horizontal direction.

The upward travel of cap 3 is of sufficient distance so that the area openings between the supports 5, when the cap is in its uppermost position, is greater than the area of exhaust pipe 2, so as not to increase the back pressure on the engine. The clearance between the supports 5 and ring 7 and the inner surface of housing 6 is sufficient to provide free floating movement without binding and locking of the sliding members.

The unit can be attached to the exhaust pipe by merely clamping the lower end 10 of the housing 8 to the pipe through use of the clamping ring 13. No modification or alteration of the exhaust pipe is required.

While the above description has illustrated the cap assembly as attached to the exhaust pipe of an internal combustion engine, it is contemplated that the cap assembly can also be associated with various other types of vent or exhaust pipes which are, in service, exposed to the elements.

Various modes of carrying out the invention are contemplated as being within the scope of the following claims particularly pointing out and distinctly claiming the subject matter which is regarded as the invention.

I claim:

1. A protective cap assembly to be attached to a vertical exhaust pipe, comprising an inverted conical cap disposed to engage the upper end of the exhaust pipe to seal the exhaust pipe when gas is not flowing through the pipe, support means connected to the cap and extending downwardly along the outer surface of the exhaust pipe, flow of gas within the exhaust pipe lifting the cap from the end of said exhaust pipe, stop means to limit the upward movement of the cap, and a housing located radially outward of said exhaust pipe, said housing having an upper end extending upwardly above the level of the cap when the cap is in sealing relation to the exhaust pipe and said housing have a lower portion disposed to be attached to said exhaust pipe.

2. The assembly of claim 1, wherein the upper portion of the housing has a larger diameter than the lower portion, and said housing includes a shoulder connecting the upper and lower portions, said shoulder having a series of drain holes to permit draining of water from the space between the exhaust pipe and the housing.

3. The assembly of claim 2, and including a clamping ring for clamping the lower portion of the housing to the exhaust pipe.

4. The assembly of claim 1, wherein said support means includes a plurality of generally vertical support members, the upper ends of the support members being connected to the cap, said support means also including a ring connected to the lower ends of the support members and mounted for sliding movement with respect to said housing.

5. The assembly of claim 4, wherein said stop means comprises an abutment secured to the inner surface of the housing and disposed to be engaged by said ring.

6. In combination, a vertical exhaust pipe disposed in combination with an internal combustion engine, and a protective cap assembly connected to the upper end of said exhaust pipe, said assembly including an inverted conical cap movable between a closed position wherein said cap is engaged with the upper end of the exhaust pipe to seal the same and an open position wherein the cap is spaced vertically above the upper end of the exhaust pipe, support means connected to the peripheral edge of the cap and extending downwardly along the outer surface of said exhaust pipe, a generally cylindrical housing spaced outwardly of said support means, said housing having an upper end extending upwardly above the level of the cap when the cap is in the closed position, said housing having a lower end portion of reduced diameter, means for securing the lower end portion of the housing to the exhaust pipe, and abutment means disposed on the inner surface of the housing and adapted to be engaged by said support means to position the cap in the open position.

7. The combination of claim 6, wherein said housing includes a shoulder portion connecting the lower portion of the housing to said upper portion, and drain means in said shoulder portion for permitting drainage of water from the space between the exhaust pipe and the housing.

8. The combination of claim 6, wherein said support means includes a series of generally vertical support members having their upper ends connected to said cap, and an annular member connected to the lower ends of the support members and mounted for sliding movement with respect to said housing.

9. The combination of claim 8, wherein said abutment means is disposed to be engaged by said annular member when said cap is in the open position.

10. The combination of claim 8, wherein the lower end portion of the housing is provided with at least one longitudinally extending slit, said drain means comprising an enlargement disposed at the upper end of the slit.

* * * * *